US011814238B2

(12) United States Patent
Zheng et al.

(10) Patent No.: US 11,814,238 B2
(45) Date of Patent: Nov. 14, 2023

(54) DRY POWDER SPRAY BOTTLE

(71) Applicants: Yuyao Doucai Plastic Industrial Co., Ltd., Yuyao (CN); Zhian Zheng, Yuyao (CN); Lijiang Xu, Yuyao (CN); Yinlong Xu, Yuyao (CN); Jiefeng Zhou, Yuyao (CN)

(72) Inventors: Zhian Zheng, Yuyao (CN); Lijiang Xu, Yuyao (CN); Yinlong Xu, Yuyao (CN); Jiefeng Zhou, Yuyao (CN)

(73) Assignee: Yuyao Doucai Plastic Industrial Co., Ltd., Yuyao (CN)

( * ) Notice: Subject to any disclaimer, the term of this patent is extended or adjusted under 35 U.S.C. 154(b) by 0 days.

(21) Appl. No.: 17/809,817

(22) Filed: Jun. 29, 2022

(65) Prior Publication Data

US 2023/0202742 A1 Jun. 29, 2023

(30) Foreign Application Priority Data

Dec. 28, 2021 (CN) ..... 202111620748.8
Dec. 28, 2021 (CN) ..... 202123338775.4

(51) Int. Cl.
*B65D 83/06* (2006.01)

(52) U.S. Cl.
CPC ..... *B65D 83/06* (2013.01)

(58) Field of Classification Search
CPC ..... B65D 83/06
USPC ..... 222/636–636, 196–201
See application file for complete search history.

(56) References Cited

U.S. PATENT DOCUMENTS 2,366,702 A * 1/1945 Ahern ..... B65D 83/06 222/211
2,610,432 A * 9/1952 Ambrose ..... B65D 83/06 366/241
2,620,095 A * 12/1952 Buchan ..... B65D 83/06 222/215
2,723,783 A * 11/1955 Ewin ..... A47K 5/10 222/425
4,007,858 A * 2/1977 Shay ..... B05B 11/045 222/633
4,044,836 A * 8/1977 Martin ..... B05B 11/041 222/215

(Continued)

FOREIGN PATENT DOCUMENTS

CN 103381937 A 11/2013

*Primary Examiner* — Vishal Pancholi
*Assistant Examiner* — Michael J. Melaragno
(74) *Attorney, Agent, or Firm* — Schwegman Lundberg & Woessner, P.A.

(57) ABSTRACT

A dry powder spray bottle includes a bottle body. The bottle body includes an outer bottle and an inner bottle, a piston and a one-way air inlet valve are sequentially arranged between the inner bottle and the outer bottle, a powder storage cavity is formed above the piston, and an airbag structure is formed between the one-way air inlet valve and the outer bottle. A rotating powder stirring mechanism is provided between the inner bottle and the outer bottle. A one-way valve is provided in the powder stirring mechanism, and when the head cap is pressed, the one-way valve opens, and gas in the airbag structure is delivered to the inner bottle through the one-way valve and sprayed out from the head cap together with dry powders, and a sealing mechanism which can close a powder outlet passage is provided between the head cap and the inner bottle.

20 Claims, 12 Drawing Sheets

(56) References Cited

U.S. PATENT DOCUMENTS

| | | | | | |
|---|---|---|---|---|---|
| 4,526,305 | A * | 7/1985 | Lykes | B65D 83/06 | 239/327 |
| 5,082,148 | A * | 1/1992 | Dunning | B65D 83/06 | 222/401 |
| 5,323,936 | A * | 6/1994 | Wolter | B05B 11/061 | 128/200.22 |
| 2004/0262340 | A1* | 12/2004 | Kress | B05B 11/062 | 222/633 |
| 2012/0097180 | A1* | 4/2012 | Harris | B65D 83/205 | 132/200 |
| 2021/0113002 | A1* | 4/2021 | Yavuz | B65D 83/06 | |
| 2023/0202742 | A1* | 6/2023 | Zheng | B65D 83/06 | 222/251 |

* cited by examiner

DRY POWDER SPRAY BOTTLE

CROSS REFERENCE TO RELATED APPLICATIONS

This Non-provisional application claims priority under 35 U.S.C. § 119(a) to Chinese Patent Application No. 202111620748.8, filed on 28 Dec. 2021, and to Chinese Patent Application No. 202123338775.4, filed on 28 Dec. 2021, the entire contents of each of which are hereby incorporated by reference in their entirety.

TECHNICAL FIELD

The disclosure relates to a container for holding dry powders, in particular to a dry powder spray bottle.

BACKGROUND ART

Currently, there are many powder products on the market, such as bath powders, baby powders, drug powders, gold powders, etc., which are generally extruded for use or for which many small holes are defined in a bottle cap and the powders can be dumped for use. Although the above two usages are convenient, there are defects that amount of the powders is not easy to be controlled and holes are easily blocked.

A spray bottle is often used to hold cosmetic liquids or the like. When in use, the cosmetic liquid is sprayed for use by pressing a head cap. However, dry powders have no same fluidity as the liquids and in order to use the dry powders in a same spraying manner as the liquids, many dry powder sprayers have appeared currently.

It is found that a spray bottle is provided in an existing Chinese patent with a patent number of CN201210140679.5, which includes: a bottle body filled with dry powders, which is characterized by a hollow conveying pipe, an upper end of which is communicated with a spout of a head cap and a lower end of which is fixed to a cylinder of a pump body and communicated with a central hole; a connector, an upper end of which is sealingly interfaced with a lower end of the pump body, and a middle part of which is provided with a powder outlet passage coaxially communicated with the conveying pipe, a bottom of the powder outlet passage being provided with a base for mixing powders and an air flow, and a powder inlet communicated with an inner cavity of the bottle body being provide at a side of the base; a set of manipulators provided at a side of the connector, upper ends of which are rotatably installed on the connector, and lower ends of which are matched with the powder inlet of the base; and a push rod movably inserted into an inner hole of the conveying pipe, an upper end of which is connected with a piston, and a lower end of which passes through a central hole of the pump body and is placed in the powder outlet passage of the connector, the push rod driving the manipulators to assign the dry powders in the bottle into the base. The spray bottle can be used easily and quickly, and is not easy to be blocked. However, the dry powders are easy to get damp, and a hole appears after each spraying, which affects spraying effect.

SUMMARY

A technical problem to be solved by the present disclosure is to provide a dry powder spray bottle with a reasonable structure and a stable and controllable powder output in view of above-described prior art.

A technical solution adopted in the disclosure to solve technical problems is as follows: a dry powder spray bottle includes a bottle body, an upper cover and a head cap with a spray port. The bottle body includes an outer bottle and an inner bottle, the inner bottle is arranged within the outer bottle, a piston and a one-way air inlet valve are sequentially arranged between a lower end of the inner bottle and an inner wall of the outer bottle, a powder storage cavity is formed above the piston, and an airbag structure is formed between a lower end of the one-way air inlet valve and the inner wall of the outer bottle. A rotating powder stirring mechanism is provided between the lower end of the inner bottle and a bottom of the outer bottle, the rotating powder stirring mechanism includes a powder stirring mechanism and a rotating mechanism. An upper end of the powder stirring mechanism sealingly passes through the one-way air inlet valve and the piston and then is disposed in the inner bottle. A one-way valve is provided in the powder stirring mechanism, and when the head cap is pressed, the one-way valve opens, and gas in the airbag structure is delivered to the inner bottle through the one-way valve and sprayed out from the head cap together with dry powders, and a sealing mechanism which can close a powder outlet passage is provided between the head cap and the inner bottle.

As an improvement, the sealing mechanism is a rotary sealing mechanism which includes a switch, the switch is arranged at an upper opening position of the inner bottle, a middle of the switch is defined with a through hole, a lower end of the switch is connected with a conveying pipe, an upper end of the switch is provided with a switch holder, an upper end of the switch holder is defined with a powder outlet, the head cap is rotatably arranged on the switch, and a plug which can close the powder outlet is convexly provided on an inner wall of a lower end face of the head cap. When the head cap rotates in place, the plug just seals the powder outlet, and an outer side of the head cap is provided with a three-dimensional rotating arrow mark for closing and opening.

Further, a lower end face of the switch is formed with a cylindrical socket for inserting the upper end of the conveying pipe, around the through hole. The switch has a circular outer edge abutting against an upper end of the inner bottle. The upper end of the switch is provided with an annular groove for inserting and rotating the lower end of the head cap, and an inner wall of the annular groove is provided with a circle of annular convex ribs. A cylindrical structure matched with the annular groove is convexly provided at the lower end of the head cap, and annular concave ribs matched with the annular convex ribs are concavely provided on an inner wall of the cylindrical structure.

As a further improvement, the upper end of the inner bottle is an externally threaded section with a reduced diameter, and the upper end of the inner bottle is connected with a coil in a threaded manner. An upper end of the coil is formed with an annular groove into which the lower end of the head cap can be placed, and the upper end of the coil is provided with an annular inner edge. The switch is arranged on the inner bottle so that the annular inner edge of the coil is positioned against the circular outer edge of the switch, and a gasket is lined between the circular outer edge of the switch and an upper end face of the inner bottle.

Further, an upper part of the piston is abutted against an inner wall of the inner bottle at its lower end, a lower part of the piston is abutted against the inner wall of the outer bottle, the one-way air inlet valve is arranged at a lower end of the piston, and the one-way air inlet valve is of a decorative cover-shaped structure with an opening in its middle. A lower end of the piston is provided with a slot into which an outer ring of the one-way air inlet valve is inserted, and the outer ring of the one-way air inlet valve is inserted into the slot; an inner ring of the one-way air inlet valve is abutted against an inner wall of the lower part of the piston; and a spring is supported between the lower end of the piston and the bottom of the outer bottle.

Further, the spring can be a metal spring or a plastic spring, an upper end face of the piston is provided with a reduced diameter opening for insertion of the powder stirring mechanism, and the powder stirring mechanism includes a hollow cylinder, an upper end of the cylinder is externally provided with a plurality of powder stirring blocks, and a V-shaped rotating block is convexly provided at a side of a lower end of the cylinder. The rotating mechanism includes an outer rotating cylinder and an inner rotating cylinder, a height of the outer rotating cylinder is higher than that of the inner rotating cylinder, and an inner wall of the outer rotating cylinder and a wall of the inner rotating cylinder are provided with rotating teeth which cooperate with the rotating block to rotate the powder stirring mechanism.

Further, there are 2 to 6 rotating teeth at even intervals, and a rotation angle of the powder stirring mechanism each time the head cap is pressed depends on a number of the rotating teeth.

Further, the bottom of the outer bottle is formed with a positioning groove into which a lower end of the rotating mechanism is placed, a lower end of the outer rotating cylinder is arranged in the positioning groove, and the inner rotating cylinder is arranged within the outer rotating cylinder.

Further, the conveying pipe is a straight pipe, a lower end of the conveying pipe is provided with a quantity controlling cover which can control powder output. An upper end of the quantity controlling cover is sleeved and fixed with the lower end of the conveying pipe, and a lower end of the quantity controlling cover is provided with a bell mouth.

Finally, the upper end of the outer bottle is provided with an internally threaded opening, a reduced diameter section of the inner bottle is provided corresponding to the internally threaded opening, a lower end of a shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle. And there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

Compared with the prior art, the disclosure has advantages as follows. The switch and a switch holder are additionally arranged between the inner bottle and the head cap, the lower end of the head cap is provided with the corresponding plug, the switch seat can be closed by rotating the head cap, and the powders can be effectively protected from getting damp. The rotating powder stirring mechanism is arranged between the bottom of the inner bottle and the bottom of the outer bottle, and the powder stirring mechanism can rotate for a certain angle each time the head cap is pressed, so that the powders in the inner bottle is uniform and the cavity can be avoided. The airbag structure is arranged between the lower end of the one-way air inlet valve and the inner wall of the outer bottle, and when the head cap is pressed, the air flow in the airbag enters the inner bottle through the one-way valve, and the entrained dry powder is spray out of the head cap through the conveying pipe. The lower end of the conveying pipe is provided with a quantity controlling cover, which can control the powder output. The disclosure provides a reasonable structure, with smooth and stable powder output, good sealing performance and convenient use.

DETAILED DESCRIPTION

The present disclosure will be further described in detail with reference to following embodiments of the drawings.

Embodiment 1

Figure 1:
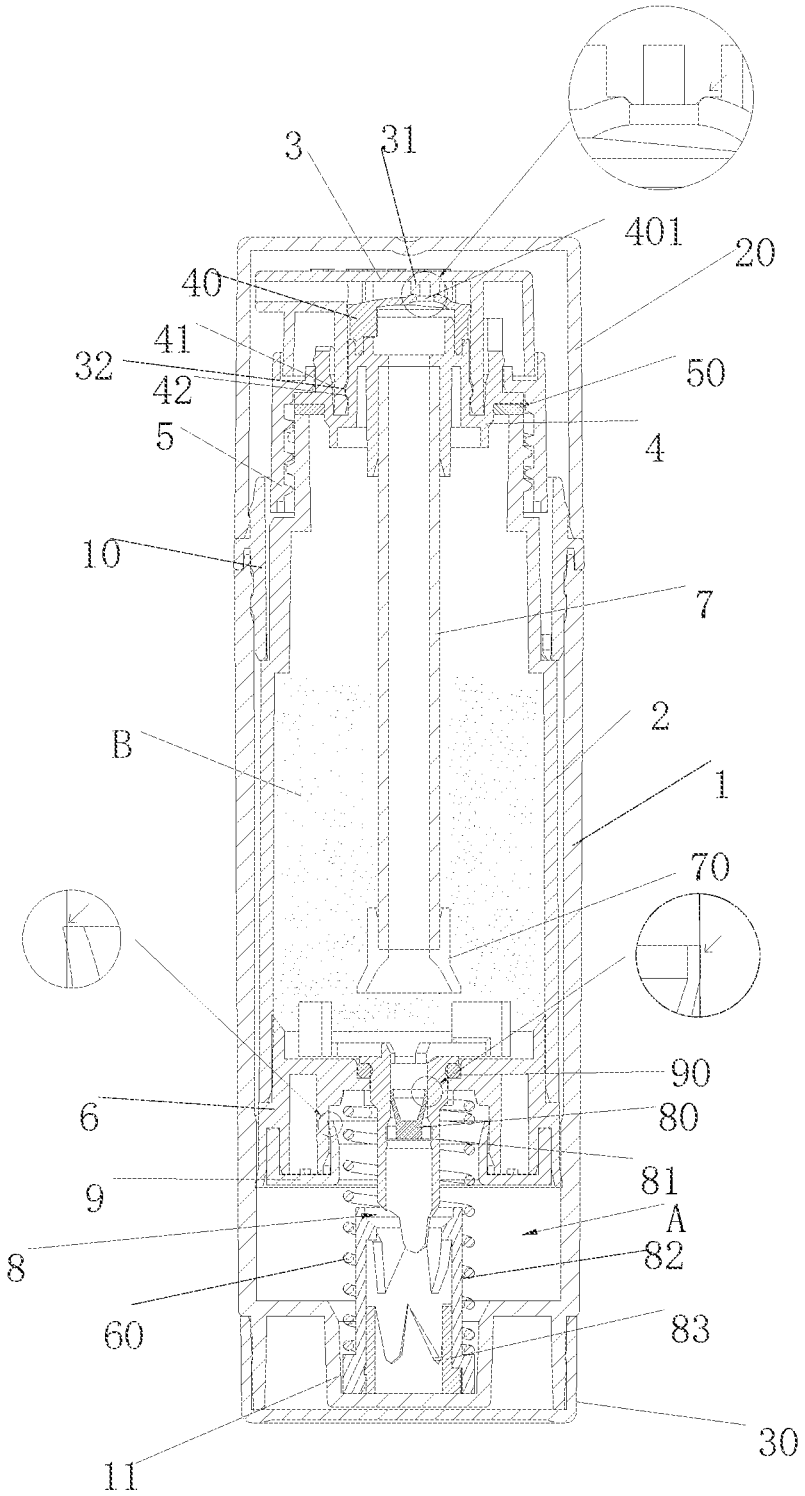
FIG. 1 is a schematic structural diagram of Embodiment 1 of the present disclosure in an initial state.
Figure 2:
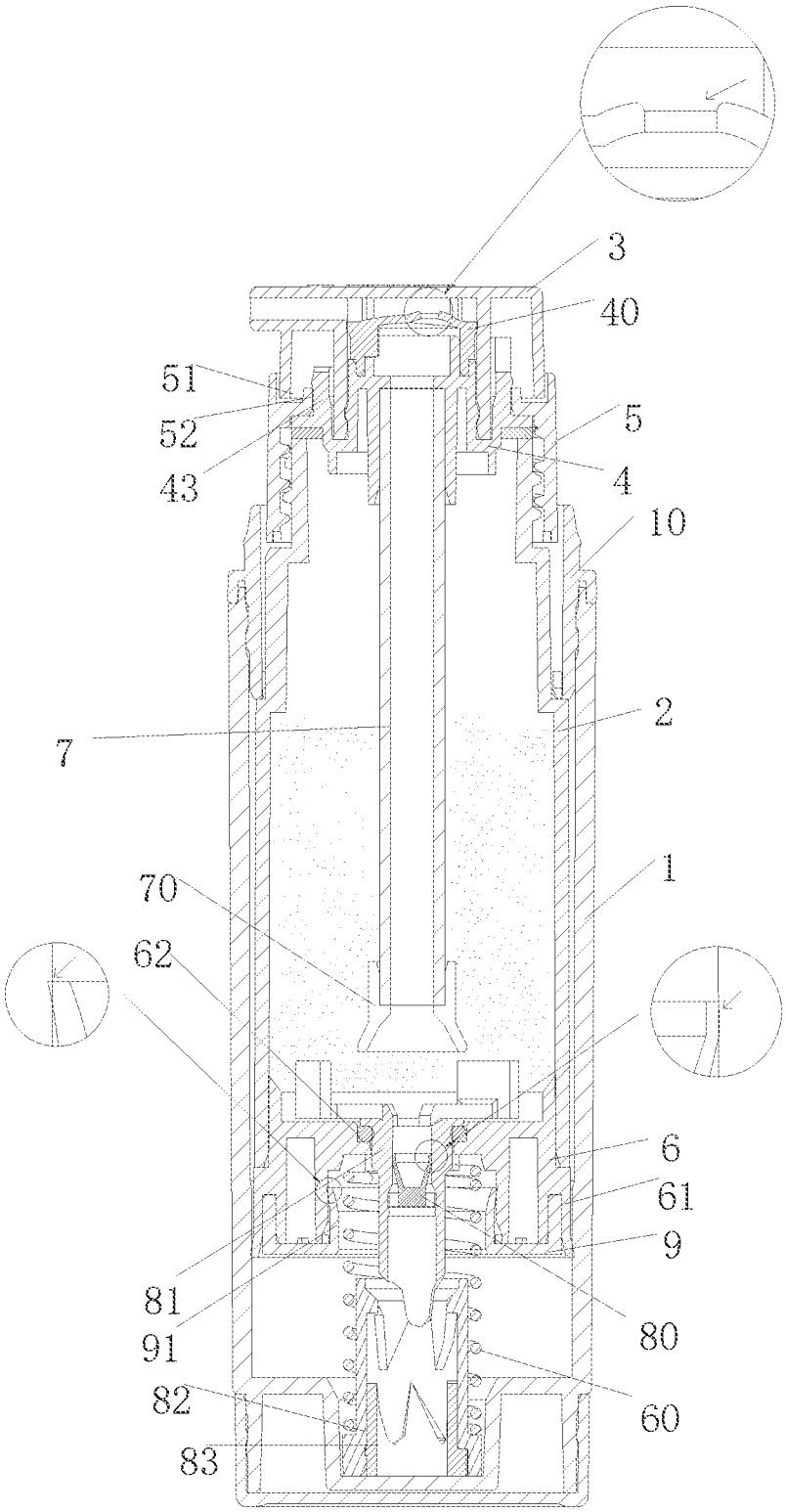
FIG. 2 is a schematic structural diagram of FIG. 1 with an upper cover being removed and a head cap being rotated.
Figure 3:
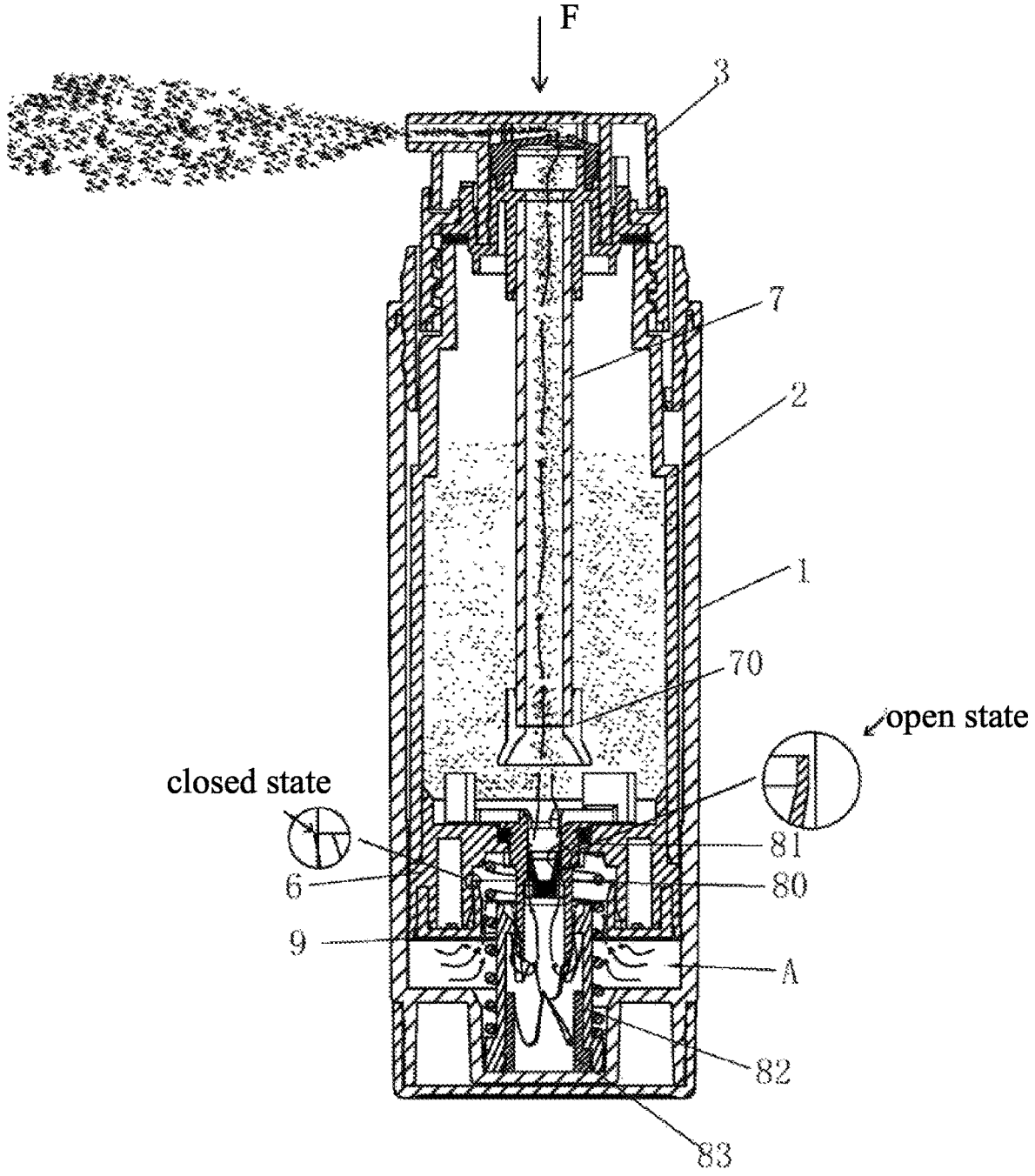
FIG. 3 is a schematic structural diagram of FIG. 2 in pressing a head cap to spray powders.

As shown in FIGS. 1 to 4, a direction indicated by an arrow in the figures is a gas flow direction. A dry powder spray bottle is provided in this embodiment, which includes a bottle body, an upper cover 20, a head cap 3 with a spray port and a bottom cover 30. The bottle body includes an outer bottle 1 and an inner bottle 2. The inner bottle 2 is arranged within the outer bottle 1, an upper end of the inner bottle 2 is connected with the outer bottle 1 through a shoulder sleeve 10, and a piston 6 and a one-way air inlet valve 9 are sequentially arranged between a lower end of the inner bottle 2 and an inner wall of the outer bottle 1. An inner bottle cavity above the piston 6 forms a powder storage cavity B, an airbag structure A is formed between the lower end of the one-way air inlet valve 9 and the inner wall of the outer bottle 1. A rotating powder stirring mechanism 8 is provided between the lower end of the inner bottle 2 and a bottom of the outer bottle 1, the rotating powder stirring mechanism 8 includes a powder stirring mechanism 81 and a rotating mechanism 84. An upper end of the powder stirring mechanism 81 sealingly passes through the one-way air inlet valve 9 and the piston 6 and then is disposed in the inner bottle 2. A one-way valve 80 is provided in the powder stirring mechanism 81, and when the head cap 3 is pressed, a force F is generated as shown in FIG. 3, the one-way valve 80 opens, and gas in the airbag structure A is delivered to the inner bottle 2 through the one-way valve 80 and sprayed out from the head cap 3 together with dry powders, and a sealing mechanism which can close a powder outlet passage is provided between the head cap 3 and the inner bottle 2.

Preferably, the sealing mechanism is a rotary sealing mechanism which includes a switch 4, the switch 4 is arranged at an upper opening position of the inner bottle 2, a middle of the switch 4 is defined with a through hole, a lower end of the switch 4 is connected with a conveying pipe 7, an upper end of the switch 4 is provided with a switch holder 40, an upper end of the switch holder 40 is defined with a powder outlet 401, the head cap 3 is rotatably arranged on the switch 4, and a plug 31 which can close the powder outlet 401 is convexly provided on an inner wall of a lower end face of the head cap 3. When the head cap 3 rotates in place, the plug 31 just seals the powder outlet 401, and an outer side of the head cap 3 is provided with a three-dimensional rotating arrow mark for closing and opening. The lower end face of the switch 4 is formed with a cylindrical socket for inserting the upper end of the conveying pipe 7, around the through hole. The switch 4 has a circular outer edge abutting against an upper end of the inner bottle 2. The upper end of the switch 4 is provided with an annular groove 41 for inserting and rotating the lower end of the head cap 3, and an inner wall of the annular groove 41 is provided with a circle of annular convex ribs 42. A cylindrical structure matched with the annular groove is convexly provided at the lower end of the head cap 3, and annular concave ribs 32 matched with the annular convex ribs are concavely provided on an inner wall of the cylindrical structure.

The upper end of the inner bottle 2 is an externally threaded section with a reduced diameter, and the upper end of the inner bottle 2 is connected with a coil 5 in a threaded manner. An upper end of the coil 5 is formed with an annular groove 51 into which the lower end of the head cap 3 can be placed, and the upper end of the coil 5 is provided with an annular inner edge 52. The switch 4 is arranged on the inner bottle 2 so that the annular inner edge 52 of the coil 5 is positioned against the circular outer edge 43 of the switch 4, and a gasket 50 is lined between the circular outer edge 43 of the switch 4 and an upper end face of the inner bottle 2.

An upper part of the piston 6 is abutted against an inner wall of the inner bottle 2 at its lower end, a lower part of the piston 6 is abutted against the inner wall 2 of the outer bottle, which normally is movably sealed, the one-way air inlet valve 9 is arranged at a lower end of the piston 6, and the one-way air inlet valve 9 is of a decorative cover-shaped structure with an opening in its middle. A lower end of the piston 6 is provided with a slot 61 into which an outer ring of the one-way air inlet valve 9 is inserted, and the outer ring of the one-way air inlet valve 9 is inserted into the slot 61; an inner ring 91 of the one-way air inlet valve 9 is abutted against an inner wall of the lower part of the piston 6, which normally is movably sealed; and a spring 60 is supported between the lower end of the piston 6 and the bottom of the outer bottle 1, so that the piston 6 always has a tendency to move upwards. The spring 60 can be a metal spring or a plastic spring, an upper end face of the piston 6 is provided with a reduced diameter opening 62 for insertion of the powder stirring mechanism 81, and the powder stirring mechanism 81 includes a hollow cylinder 8*a*, an upper end of the cylinder 8*a* is externally provided with a plurality of powder stirring blocks 8*b* which can be uniformly and circumferentially distributed, and a V-shaped rotating block 8*c* is convexly provided at a side of a lower end of the cylinder 8*a*. The rotating mechanism 84 includes an outer rotating cylinder 82 and an inner rotating cylinder 83, a height of the outer rotating cylinder 82 is higher than that of the inner rotating cylinder 83, and an inner wall of the outer rotating cylinder 82 and a wall of the inner rotating cylinder 83 are provided with rotating teeth 831 which cooperate with the rotating block 8*c* to rotate the powder stirring mechanism 81. There are 2 to 6 rotating teeth 831 at even intervals, and a rotation angle of the powder stirring mechanism 81 each time the head cap 3 is pressed depends on a number of the rotating teeth 831. In this embodiment, there are four rotating teeth 831, and the powder stirring mechanism 81 rotates by 90 each time the head cap 3 is pressed. The bottom of the outer bottle 1 is formed with a positioning groove 11 into which a lower end of the rotating mechanism is placed, a lower end of the outer rotating cylinder 82 is arranged in the positioning groove 11, and the inner rotating cylinder 83 is arranged within the outer rotating cylinder 82. Bottoms of the both are flush with each other, a similar rotating mechanism can be referred to a rotating color changing mechanism of a ballpoint pen refill.

The conveying pipe 7 is a straight pipe, a lower end of the conveying pipe 7 is provided with a quantity controlling cover 70 which can control powder output. An upper end of the quantity controlling cover 70 is sleeved and fixed with the lower end of the conveying pipe 7, and a lower end of the quantity controlling cover 70 is provided with a bell mouth.

The airbag structure A is also provided with an air passage which communicates with outside atmosphere. This passage can be controlled to be closed by the one-way air inlet valve 9 (the air passage opens when the valve opens and closes when the valve closes). The inner ring 91 of the one-way air inlet valve 9 is sealed against the lower inner wall of the piston 6, normally is movably sealed. When the head cap 3 is pressed, a pressure in the airbag structure A increases, and the air inlet valve 9 closes and is sealed more firmly. When the head cap 3 is loosened, the one-way valve 80 is closed, a volume of the airbag structure A becomes larger, and a negative pressure is formed inside. As the inlet valve 9 is an elastic silica gel valve, it will deform and open at this time, and air will be sucked into the airbag structure A through the passage 200 and the gap 100. The upper end of the outer bottle 1 is provided with a circle of convex ribs and a reduced diameter section of the inner bottle 2 is provided corresponding to the internally threaded opening; a lower end of the shoulder sleeve 10 is provided with inner concave ribs corresponding to the convex ribs of the outer bottle 1. The shoulder sleeve 10 is clamped at the upper end of the outer bottle 1, the lower end of the shoulder sleeve 10 abuts against a step of the inner bottle 2. There are certain gaps 100 between the shoulder sleeve 10 and the inner bottle 2 and between the inner bottle 2 and the outer bottle 1 for an air flow to pass through, which communicate with outside atmosphere, and a passage 200 is provided between the piston 6 and the one-way air inlet valve 9 to communicate the gaps 100 of the inner bottle 2 and the outer bottle 1 and the airbag structure A, and the passage 200 is further controlled to be closed by the one-way air inlet valve 9. An arrangement of the passage 200 can be flexibly provided, which is not limited to illustration of this embodiment. The upper cover 20 is a transparent cover, which is arranged outside the shoulder sleeve 10 and is flush with the bottle body 1. The upper end of the outer bottle 2 is provided with an externally threaded connection section with a reduced diameter, and the bottom cover 30 is fixed with the lower end of the outer bottle 1 by clamping the convex ribs and the concave ribs.

A working principle of the disclosure is: with the air carrying dry powders being sprayed out of the head cap 3, and ease of getting damp of dry powders, a rotary sealing mechanism is provided at the head cap 3. As the dry powders do not have good fluidity, a hole appears after each spraying, so the rotating powder stirring mechanism 8 is arranged at the lower end of the inner bottle 2, so that a powder stirring action can be performed each time the head cap 3 is pressed. The quantity controlling cover 70 is arranged below the conveying pipe 7, which can well control the powder output, adjust a size of the bell mouth of the quantity controlling cover 70 so as to further control the powder output.

An operation process specifically is as follows.

1. In an initial state, as shown in FIG. 1, the plug 31 at the lower end of the head cap 3 is abutted against the powder outlet 401 of the switch seat 40, so that the dry powders in the inner bottle 2 is isolated from the outside world, does not get damp, and always keeps dry.

2. When the upper cover 20 is taken off and the head cap 3 is rotated to open the powder outlet 401 of the switch holder 40, as shown in FIG. 2, a passage is formed with the outside world for the dry powders, so that the powders can be discharged smoothly.

3. When the head cap 3 is pressed and the inner bottle 2 moves downwards, at this time, the one-way air inlet valve 9 is closed, as shown in FIG. 3, the airbag structure A keeps shrinking. As the one-way valve 80 is an elastic silica gel valve, it deforms and opens under the pressure, and the air flow passes through the one-way valve 80, and the entrained dry powder is sprayed out of the head cap through the conveying pipe 7. At the same time, the powder stirring mechanism 81 is rotated by 90 degrees to stir the dry powder.

Figure 4:
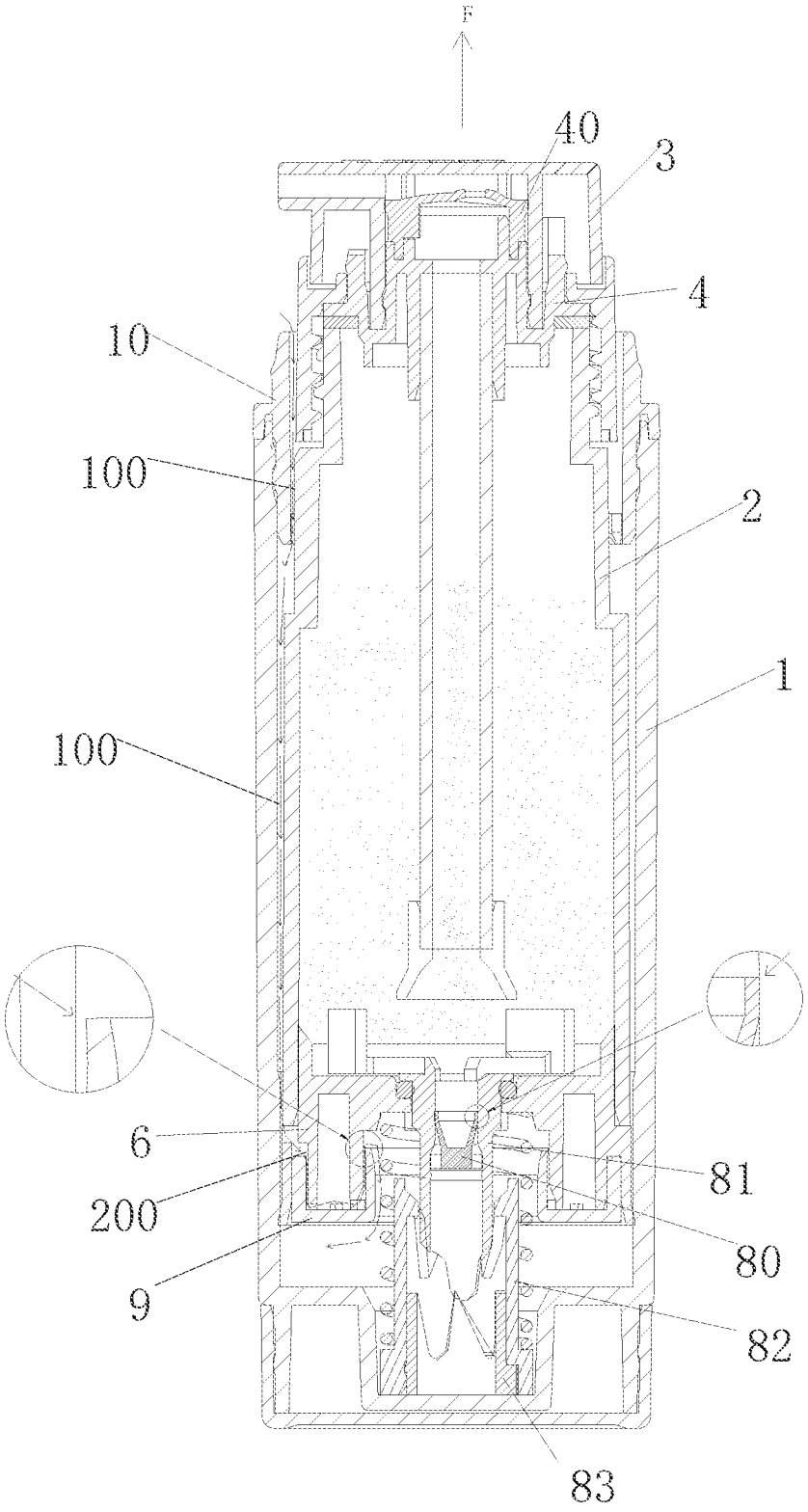
FIG. 4 is a schematic diagram of a structure after a powder spraying is finished and the head cap is loosened.
Figure 5:
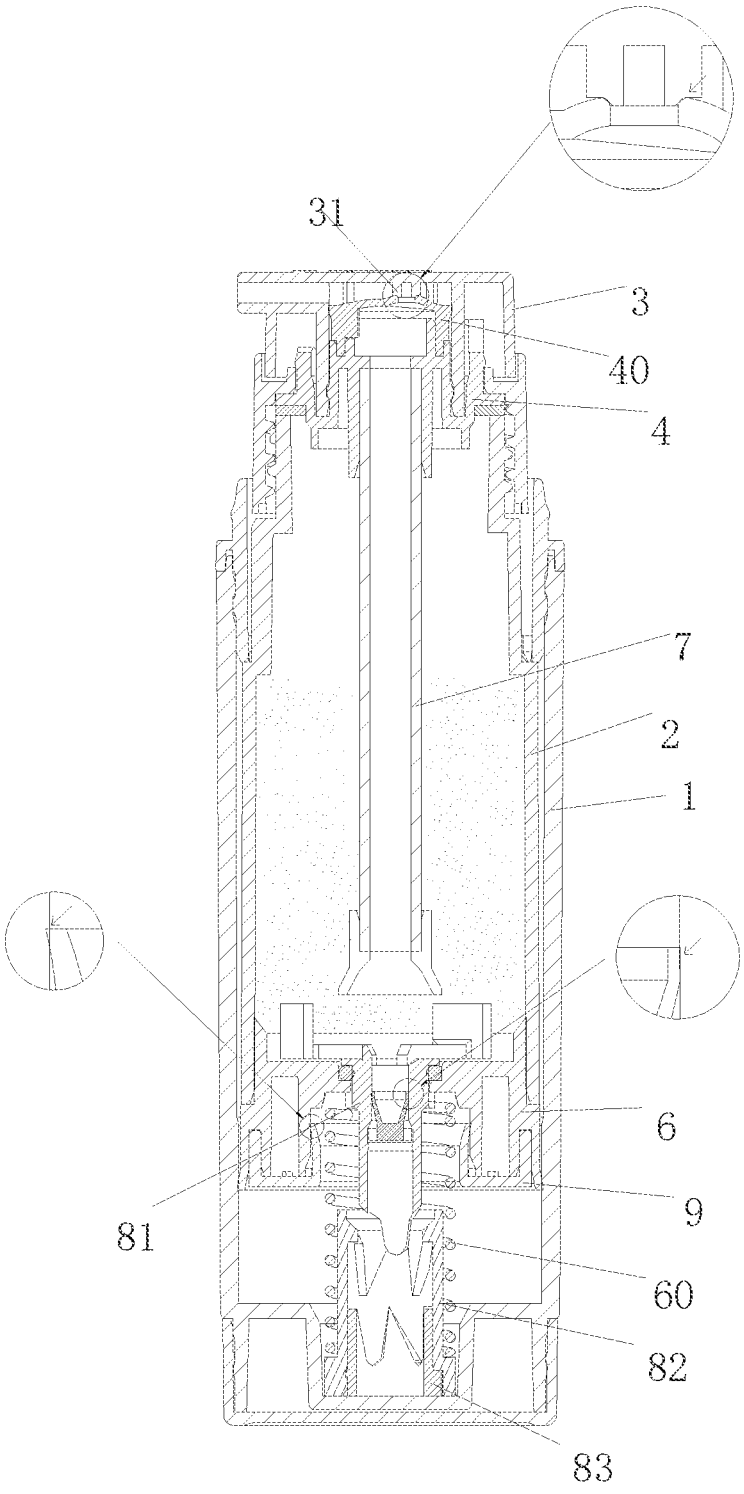
FIG. 5 is a schematic diagram of a structure after the head cap is closed.
Figure 6:
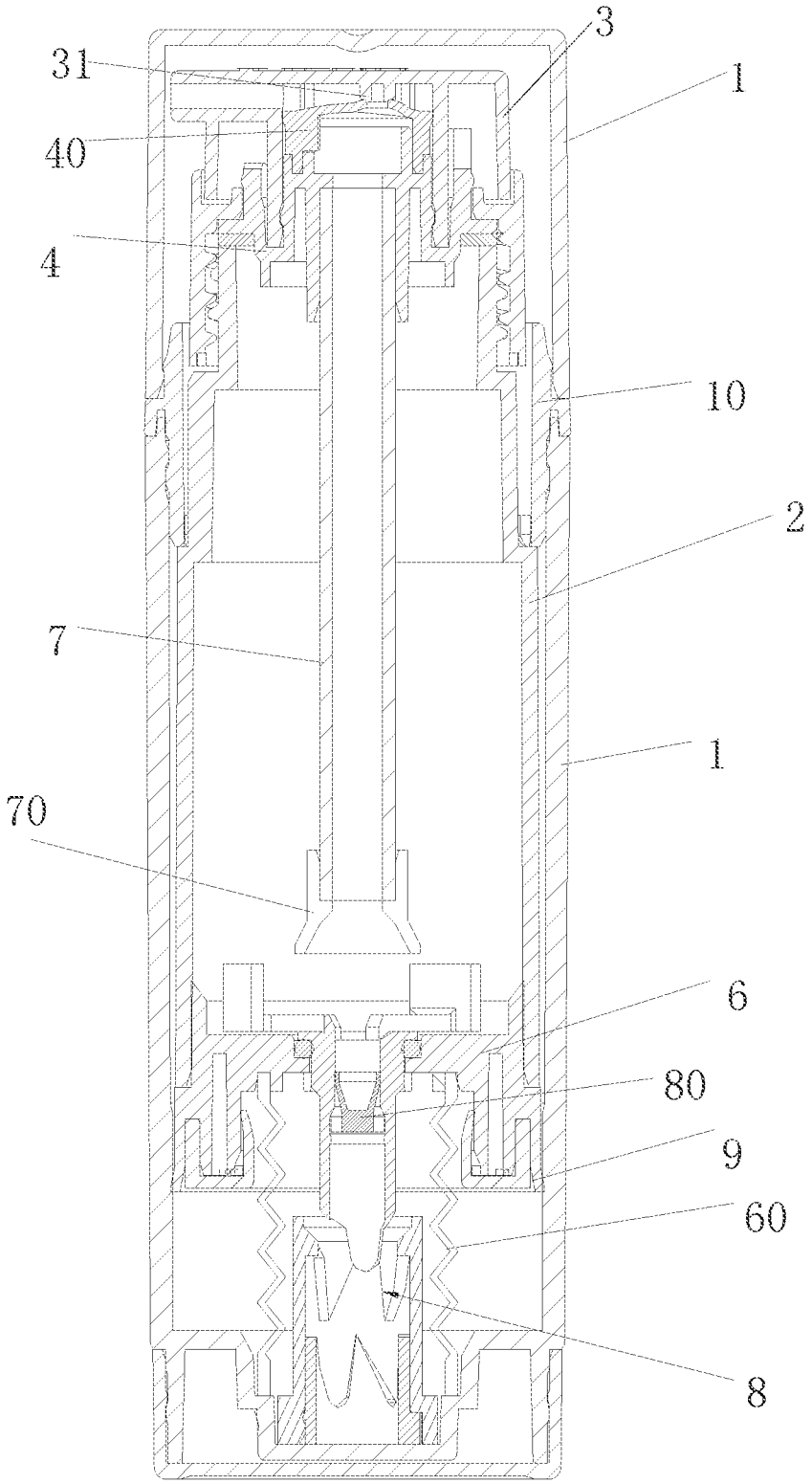
FIG. 6 is a schematic structure diagram a structure using a plastic spring.
Figure 7:
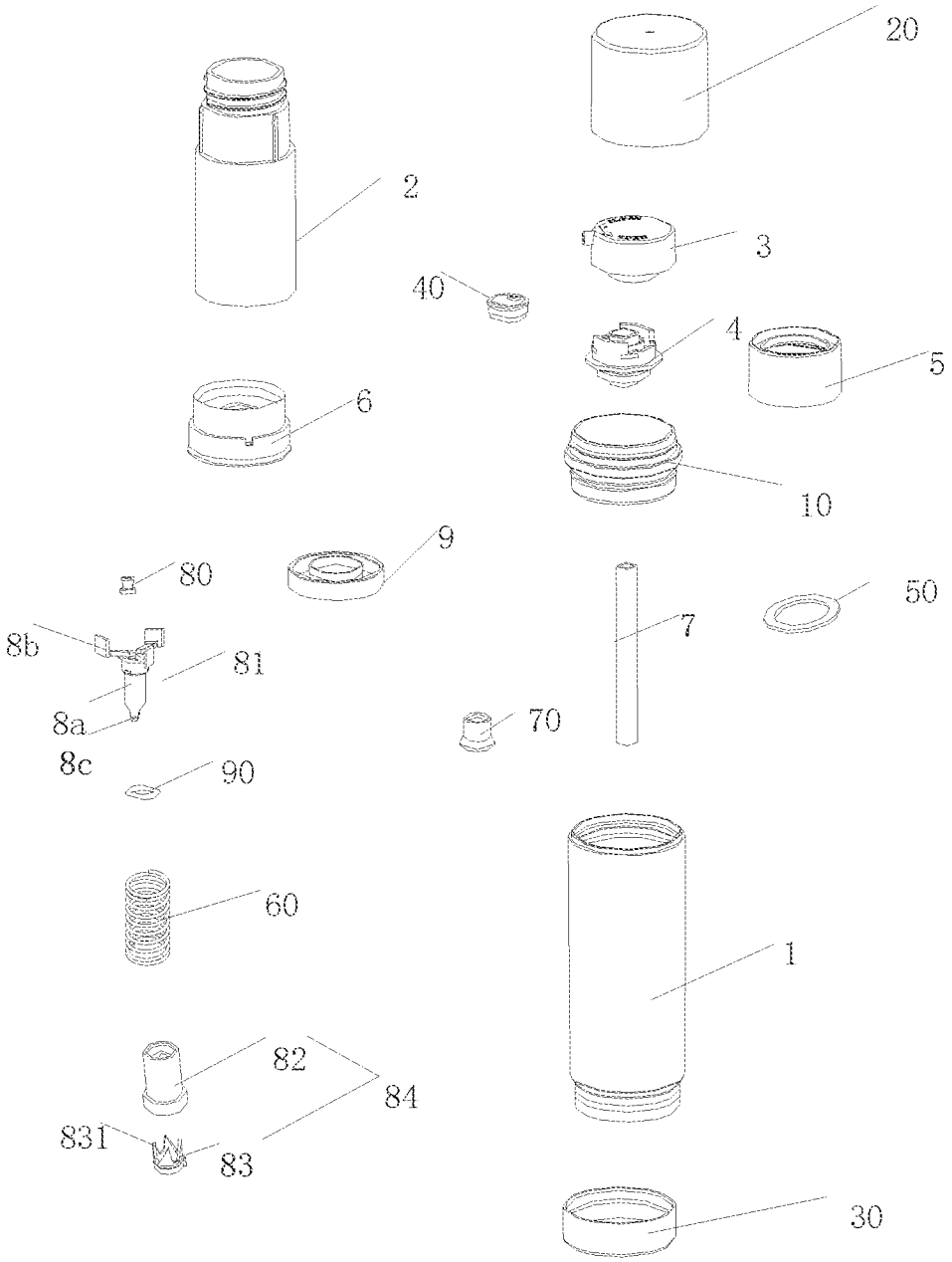
FIG. 7 is an exploded view of FIG. 1.

4. When the head cap 2 is loosened and under action of the spring 60, the inner bottle 2 and the head cap 3 move upward, as shown in FIG. 4, the one-way valve 80 is closed to prevent the dry powders from being sucked into the airbag A. At this time, the one-way air inlet valve 9 is opened and the passage 200 is opened, and air enters the airbag A. In a process of loosening the head cap 3, the powder stirring mechanism 81 rotates again to prepare for a next powder spraying.

5. After use, the head cap 3 is turned to close the powder outlet 401 to prevent the dry powders from getting damp.

Embodiment 2

Figure 8:
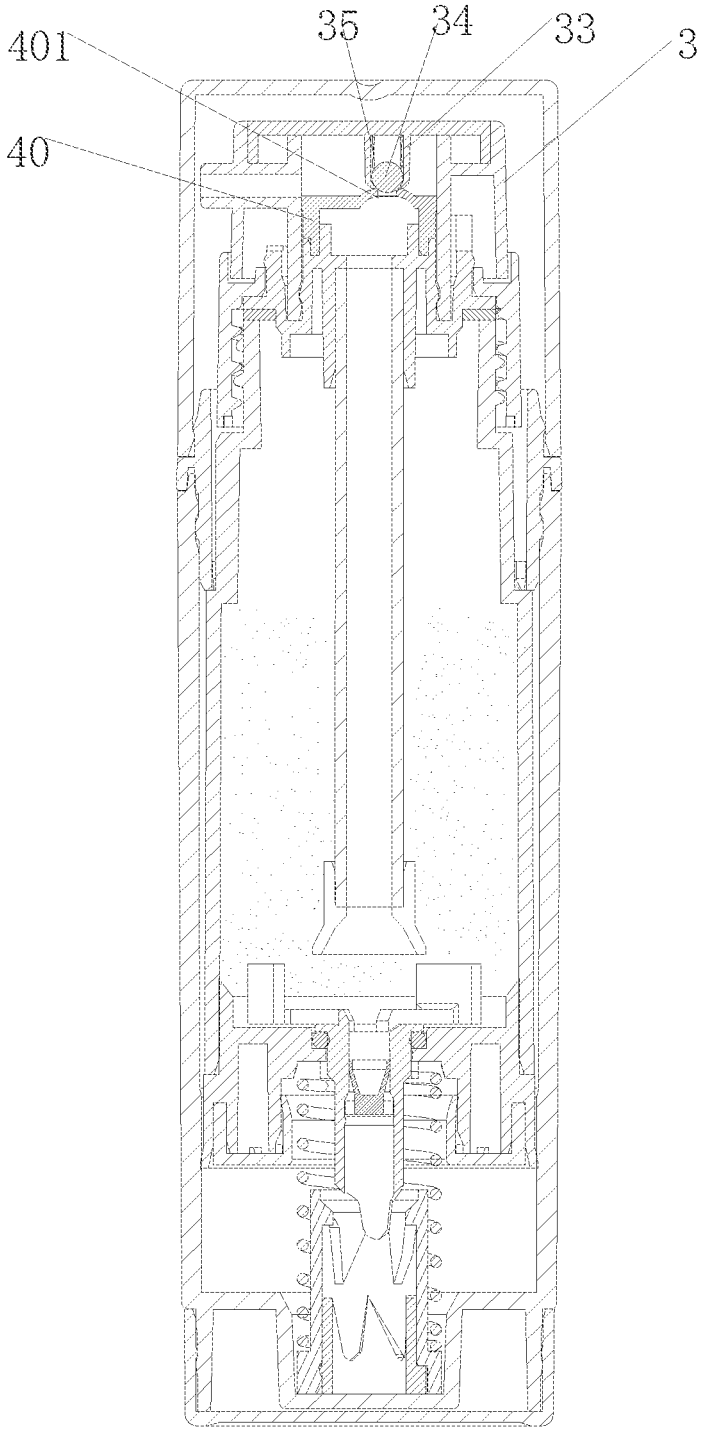
FIG. 8 is a cross-sectional view of Embodiment 2.
Figure 9:
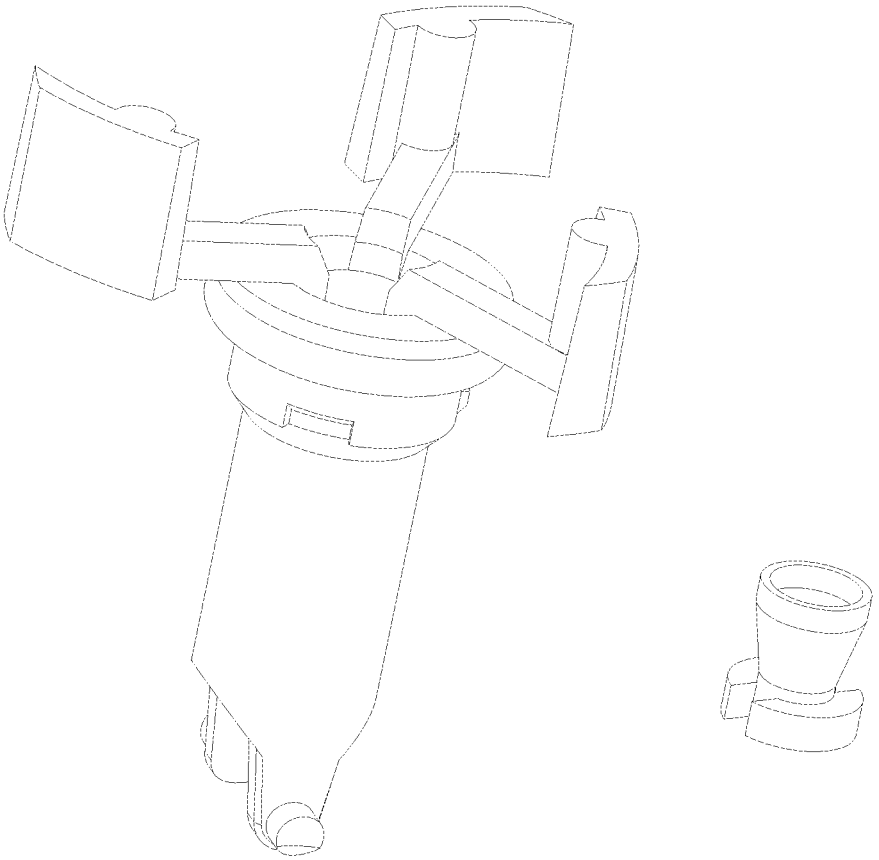
FIG. 9 is a schematic structural diagram of a powder stirring mechanism and a one-way valve used in Embodiments 1 and 2.

As shown in FIG. 8, the head cap 3 is arranged on the switch 4, and the one-way valve seat 33 is convexly provided on an inner wall of the lower end face of a top of the head cap 3, and a spring 35 and a sealing bead 34 are arranged in the one-way valve seat 33, so that a sealing bead 34 cooperates with the powder outlet 401 to realize a function of closing the one-way valve, so that a sealing mechanism capable of closing the powder outlet passage is provided between the head cap 3 and the inner bottle 2. Other configuration is similar to that of Embodiment 1.

Embodiment 3

Figure 10:
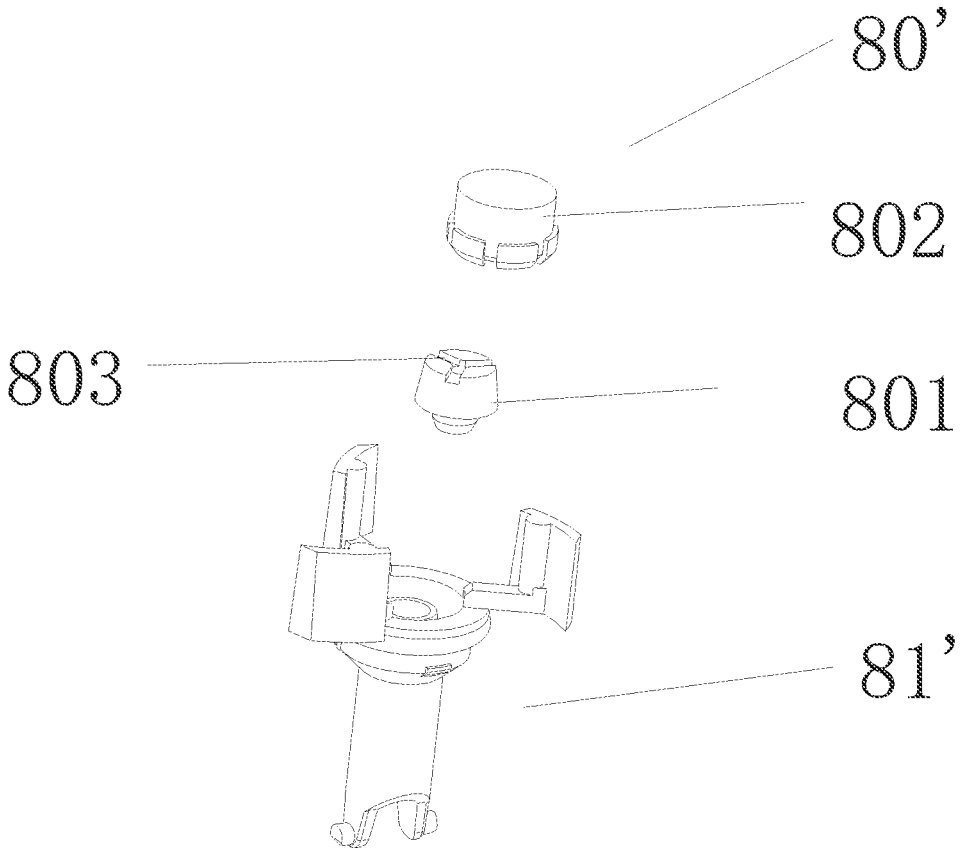
FIG. 10 is a schematic structural diagram of a powder stirring mechanism and a one-way valve used in Embodiment 3.
Figure 11:
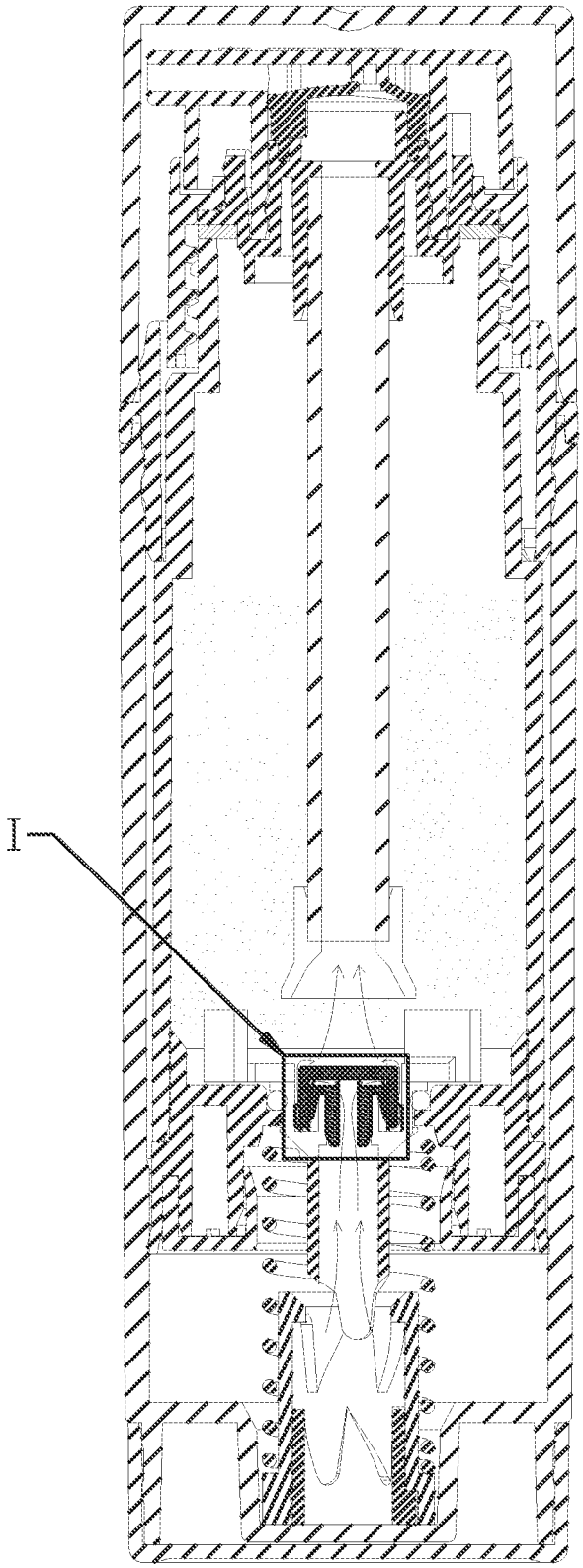
FIG. 11 is a schematic structural diagram of a whole spray bottle in Embodiment 3.
Figure 12:
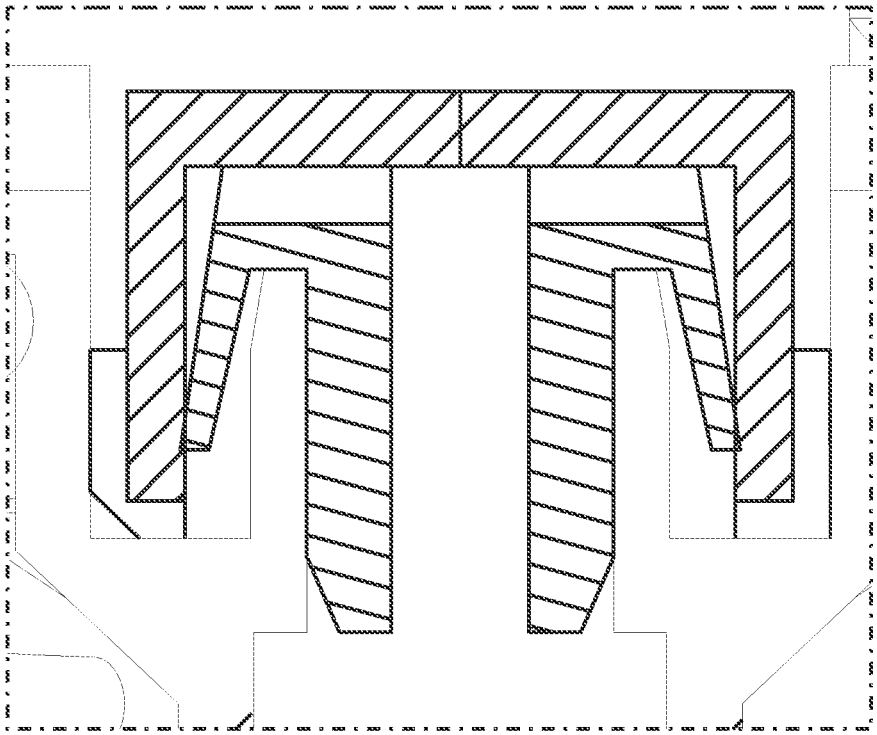
FIG. 12 is a partially enlarged schematic view of tan area I in FIG. 11 in a closed state.
Figure 13:
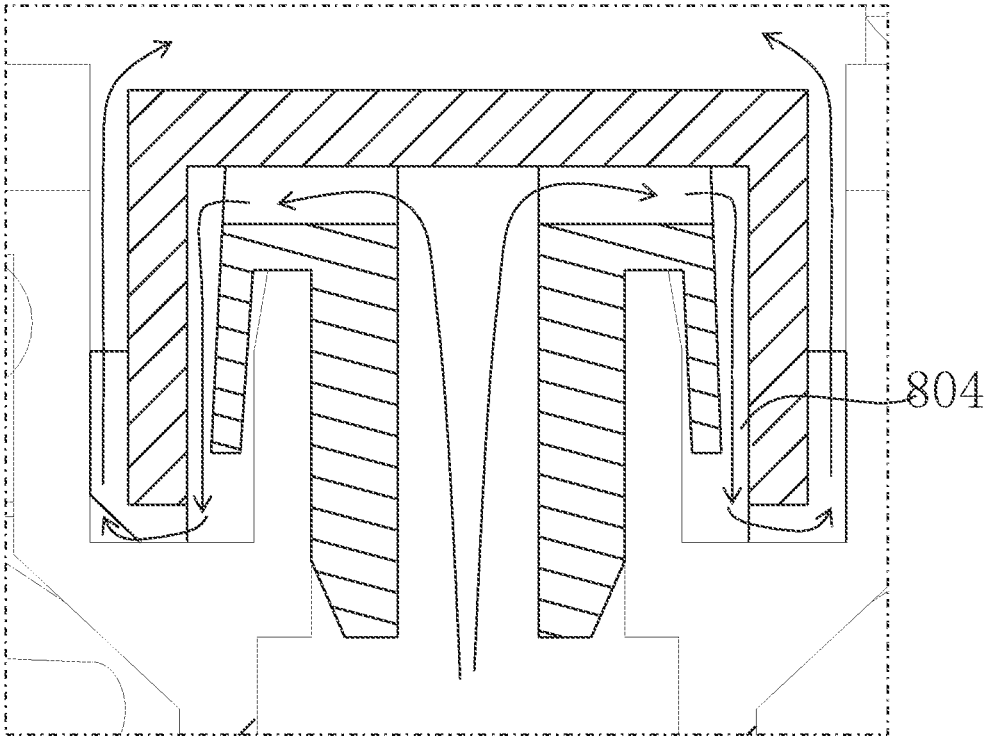
FIG. 13 is a partially enlarged schematic view of tan area I in FIG. 11 in an opening state.

Referring to FIGS. 10 to 12, a structure and shape of a spray bottle provided in this embodiment are basically the same as those in Embodiment 1, and only differences will be explained below. In order to prevent powder leakage and prevent the powders from entering the airbag, the one-way valve 80' in this embodiment includes a top cover 802 and a one-way valve body 801. The top cover 802 covers above the one-way valve body for covering and preventing powder leakage, and the one-way valve body 801 is generally frusto-conical shaped. The one-way valve body 801 is inserted into a hollow part of a cylinder of a stirring mechanism, and the hollow part communicates with the airbag A. A side of the one-way valve body 801 proximate to the top cover is provided with a groove for an air flow to pass through, and a vent hole communicating with the hollow part of the cylinder is provided inside of the one-way valve body 801, and the vent hole communicates with the groove. The one-way valve body 801 is an elastic silica gel valve, and the top cover can be made of hard materials such as plastic. An inner wall of the top cover 802 and an inclined folded edge of the one-way valve main body 801 form a valve so as to be sealed against each other, normally to be movably sealed. When the head cap 3 is pressed, the pressure increases as the airbag structure A keeps shrinking, and the one-way valve main body 801 is deformed and opened under influence of the pressure, thus realizing opening of a passage 804 and loosening the head cap 3. When a volume of the airbag structure A increases, the one-way valve main body 801 returns to its original state and forms a valve with the inner wall of the top cover 802 so as to be sealed against each other, and the passage 804 is closed. The structure of the stirring mechanism 81' matched with the one-way valve in this embodiment has been modified adaptively, which is not limited in this application.

The above are only preferred embodiments of the present disclosure. It should be pointed out that some improvements and modifications can be made by those of ordinary skilled in the art without departing from technical principle of the present disclosure, which should also be regarded to be within a protection scope of the present disclosure.

What is claimed is:

1. A dry powder spray bottle, comprising: a bottle body, an upper cover and a head cap with a spray port, wherein the bottle body comprises an outer bottle and an inner bottle, the inner bottle being arranged within the outer bottle, a piston and a one-way air inlet valve being sequentially arranged between a lower end of the inner bottle and an inner wall of the outer bottle, a powder storage cavity being formed above the piston, and an airbag structure being formed between a lower end of the one-way air inlet valve and the inner wall of the outer bottle, a rotating powder stirring mechanism being provided between the lower end of the inner bottle and a bottom of the outer bottle, the rotating powder stirring mechanism comprising a powder stirring mechanism and a rotating mechanism; an upper end of the powder stirring mechanism sealingly passing through the one-way air inlet valve and the piston and then being disposed in the inner bottle, a one-way valve being provided in the powder stirring mechanism; when the head cap is pressed, the one-way valve opening and gas in the airbag structure being delivered to the inner bottle through the one-way valve and sprayed out from the head cap together with dry powders; and a sealing mechanism which closes a powder outlet passage being provided between the head cap and the inner bottle.

2. The dry powder spray bottle according to claim 1, wherein the sealing mechanism is a rotary sealing mechanism which comprises a switch, the switch being arranged at an upper opening position of the inner bottle, a middle of the switch being defined with a through hole, a lower end of the switch being connected with a conveying pipe, an upper end of the switch being provided with a switch holder, an upper end of the switch holder being defined with a powder outlet, the head cap being rotatably arranged on the switch, and a plug which closes the powder outlet being convexly provided on an inner wall of a lower end face of the head cap; when the head cap rotates in place, the plug just sealing the powder outlet, and an outer side of the head cap being provided with a three-dimensional rotating arrow mark for closing and opening.

3. The dry powder spray bottle according to claim 2, wherein a lower end face of the switch is formed with a cylindrical socket for inserting the upper end of the conveying pipe, around the through hole, the switch has a circular outer edge abutting against an upper end of the inner bottle; the upper end of the switch is provided with an annular groove for inserting and rotating the lower end of the head cap, and an inner wall of the annular groove is provided with a circle of annular convex ribs; a cylindrical structure matched with the annular groove is convexly provided at the lower end of the head cap, and annular concave ribs matched with the annular convex ribs are concavely provided on an inner wall of the cylindrical structure.

4. The dry powder spray bottle according to claim 3, wherein the upper end of the inner bottle is an externally threaded section with a reduced diameter, and the upper end of the inner bottle is connected with a coil in a threaded manner, an upper end of the coil is formed with an annular groove into which the lower end of the head cap is placed, and the upper end of the coil is provided with an annular inner edge; the switch is arranged on the inner bottle so that the annular inner edge of the coil is positioned against the circular outer edge of the switch, and a gasket is lined between the circular outer edge of the switch and an upper end face of the inner bottle.

5. The dry powder spray bottle according to claim 4, wherein an upper part of the piston is abutted against an inner wall of the inner bottle at the lower end of the inner bottle, a lower part of the piston is abutted against the inner wall of the outer bottle, the one-way air inlet valve is arranged at a lower end of the piston, and the one-way air inlet valve is of a decorative cover-shaped structure with an opening in its middle; a lower end of the piston is provided with a slot into which an outer ring of the one-way air inlet valve is inserted, and the outer ring of the one-way air inlet valve is inserted into the slot; an inner ring of the one-way air inlet valve is abutted against an inner wall of the lower part of the piston; and a spring is supported between the lower end of the piston and the bottom of the outer bottle.

6. The dry powder spray bottle according to claim 5, wherein the spring is a metal spring or a plastic spring, an upper end face of the piston is provided with a reduced diameter opening for insertion of the powder stirring mechanism, and the powder stirring mechanism comprises a hollow cylinder, an upper end of the cylinder being externally provided with a plurality of powder stirring blocks and a V-shaped rotating block being convexly provided at a side of a lower end of the cylinder; the rotating mechanism comprises an outer rotating cylinder and an inner rotating cylinder, a height of the outer rotating cylinder being higher than that of the inner rotating cylinder, and an inner wall of the outer rotating cylinder and an wall of the inner rotating cylinder being provided with rotating teeth which cooperate with the rotating block to rotate the powder stirring mechanism.

7. The dry powder spray bottle according to claim 6, wherein there are 2 to 6 rotating teeth at even intervals, and a rotation angle of the powder stirring mechanism each time the head cap is pressed depends on a number of the rotating teeth.

8. The dry powder spray bottle according to claim 7, wherein the bottom of the outer bottle is formed with a positioning groove into which a lower end of the rotating mechanism is placed, a lower end of the outer rotating cylinder is arranged in the positioning groove, and the inner rotating cylinder is arranged within the outer rotating cylinder.

9. The dry powder spray bottle according to claim 2, wherein the conveying pipe is a straight pipe, a lower end of the conveying pipe is provided with a quantity controlling cover which controls powder output; an upper end of the quantity controlling cover is sleeved and fixed with the lower end of the conveying pipe, and a lower end of the quantity controlling cover is provided with a bell mouth.

10. The dry powder spray bottle according to claim 1, wherein the upper end of the outer bottle is provided with an internally threaded opening, a reduced diameter section of the inner bottle is provided corresponding to the internally threaded opening, an upper end of the inner bottle is connected with the outer bottle through a shoulder sleeve, a lower end of the shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle; and there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

11. The dry powder spray bottle according to claim 3, wherein the conveying pipe is a straight pipe, a lower end of the conveying pipe is provided with a quantity controlling cover which controls powder output; an upper end of the quantity controlling cover is sleeved and fixed with the lower end of the conveying pipe, and a lower end of the quantity controlling cover is provided with a bell mouth.

12. The dry powder spray bottle according to claim 4, wherein the conveying pipe is a straight pipe, a lower end of the conveying pipe is provided with a quantity controlling cover which controls powder output; an upper end of the quantity controlling cover is sleeved and fixed with the lower end of the conveying pipe, and a lower end of the quantity controlling cover is provided with a bell mouth.

13. The dry powder spray bottle according to claim 8, wherein the conveying pipe is a straight pipe, a lower end of the conveying pipe is provided with a quantity controlling cover which controls powder output; an upper end of the quantity controlling cover is sleeved and fixed with the lower end of the conveying pipe, and a lower end of the quantity controlling cover is provided with a bell mouth.

14. The dry powder spray bottle according to claim 2, wherein the upper end of the outer bottle is provided with an internally threaded opening, a reduced diameter section of the inner bottle is provided corresponding to the internally threaded opening, an upper end of the inner bottle is connected with the outer bottle through a shoulder sleeve, a lower end of the shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle; and there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

15. The dry powder spray bottle according to claim 3, wherein the upper end of the outer bottle is provided with an internally threaded opening, a reduced diameter section of the inner bottle is provided corresponding to the internally threaded opening, an upper end of the inner bottle is connected with the outer bottle through a shoulder sleeve, a lower end of the shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle; and there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

16. The dry powder spray bottle according to claim 4, wherein the upper end of the outer bottle is provided with an internally threaded opening, a reduced diameter section of the inner bottle is provided corresponding to the internally threaded opening, an upper end of the inner bottle is connected with the outer bottle through a shoulder sleeve, a lower end of the shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle; and there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

17. The dry powder spray bottle according to claim 8, wherein the upper end of the outer bottle is provided with an internally threaded opening, a reduced diameter section of the inner bottle is provided corresponding to the internally threaded opening, an upper end of the inner bottle is connected with the outer bottle through a shoulder sleeve, a lower end of the shoulder sleeve is provided with external threads corresponding to the internally threaded opening of the outer bottle, the lower end of the shoulder sleeve is threaded to the upper end of the outer bottle, the lower end of the shoulder sleeve is abutted against a step of the inner bottle; and there are certain gaps between the shoulder sleeve and the inner bottle and between the inner bottle and the outer bottle for the air flow to pass through, and a passage is provided between the piston and the one-way air inlet valve to communicate the gaps and the airbag structure, and the passage is further controlled to be closed by the one-way air inlet valve.

18. The dry powder spray bottle according to claim 1, wherein the one-way valve comprises a top cover and a one-way valve body, the top cover covers above the one-way valve body for covering and preventing powder leakage.

19. The dry powder spray bottle according to claim 18, wherein the one-way valve body is inserted into a hollow part of a cylinder of a stirring mechanism, and the hollow part communicates with the airbag, a side of the one-way valve body proximate to the top cover is provided with a groove for an air flow to pass through, and a vent hole communicating with the hollow part of the cylinder is provided inside of the one-way valve body, and the vent hole communicates with the groove.

20. The dry powder spray bottle according to claim 19, wherein the one-way valve body is an elastic silica gel valve, and the top cover is made of hard materials, an inner wall of the top cover and an inclined folded edge of the one-way valve main body form a movably valve so as to be sealed against each other.

* * * * *